United States Patent [19]

Goldberg

[11] 4,111,636

[45] Sep. 5, 1978

[54] METHOD AND APPARATUS FOR REDUCING POLLUTANT EMISSIONS WHILE INCREASING EFFICIENCY OF COMBUSTION

[75] Inventor: Leon Goldberg, Potomac, Md.

[73] Assignee: Lawrence P. Weinberger, Silver Spring, Md. ; a part interest

[21] Appl. No.: 747,190

[22] Filed: Dec. 3, 1976

[51] Int. Cl.[2] ..... F23B 7/00

[52] U.S. Cl. ..... 431/2; 55/2; 55/12; 431/4

[58] Field of Search ..... 431/2, 4, 76, 8; 55/2, 55/12

[56] References Cited

U.S. PATENT DOCUMENTS

| | | | |
|---|---|---|---|
| 3,224,485 | 12/1965 | Blomgren et al. | 431/2 X |
| 3,306,338 | 2/1967 | Wright et al. | 431/2 X |
| 3,503,348 | 3/1970 | Dvirka | 55/2 X |
| 3,749,545 | 7/1973 | Velkoff | 431/2 |
| 3,841,824 | 10/1974 | Bethel | 431/2 X |
| 3,869,362 | 3/1975 | Machi et al. | 55/2 X |

*Primary Examiner*—Edward G. Favors
*Attorney, Agent, or Firm*—Cantor and Singer

[57] ABSTRACT

A method and apparatus for reducing pollutant emissions from a source of combustion while simultaneously increasing the combustion efficiency. In a preferred mode, the technique contemplates the separation, removal and collection of positively charged species at the combustion zone. This is achieved by applying a relatively small magnitude electrostatic field at the combustion zone via positive and negative electrode means. A negative electrode may be positioned adjacent aperture means formed in the sidewall of the combustion chamber at the combustion zone so as to attract positive ionic species that include the pollutant emissions (e.g., $NO^+$) desired to be extracted. A negative electrode may also be electrically connected to a tube that serves to collect the pollutant for later processing to a useful by-product (e.g., nitrogenous fertilizer). Effective removal of the ionic species at the combustion zone permits combustion to occur at higher temperatures which, in turn, results in greater combustion efficiency.

38 Claims, 4 Drawing Figures

METHOD AND APPARATUS FOR REDUCING POLLUTANT EMISSIONS WHILE INCREASING EFFICIENCY OF COMBUSTION

BACKGROUND OF THE INVENTION

1. Field of the Invention

The present invention is related generally to combustion processes and, more particularly, is directed towards a method and apparatus for synergistically reducing pollutant emissions while simultaneously increasing the efficiency of combustion. Even more particularly, the present invention is directed towards a method for enhancing the production of NO+ during combustion, and for separating, removing and extracting same for later processing into a valuable product.

2. Description of the Prior Art

Today, nitrogenous fertilizer is mainly derived from ammonia synthesized in the Haber-Bosch process from methane gas. In fact, in 1974, nearly 15% of all methane consumed in the United States went for the production of nitrogenous fertilizer. By the year 2000, it is estimated that five times as much fertilizer will be required, but the source of such fertilizer is not yet resolved.

Nitrogenous fertilizer is naturally formed in large quantities during an electrical lightning storm as a result of the formation of significant quantities of nitrogen oxides, $NO_x$, which are in turn formed whenever the temperature of air is raised substantially. Man-made electric arcs have also been used to produce $NO_x$, but this technique has been discarded in favor of others which require less energy.

$NO_x$ is also quite readily formed during high temperature combustion involving fossil fuels and air. $NO_x$ formation by this technique has heretofore been recognized as being potentially quite useful, as, for example, a feedstock for nitrogenous fertilizer. See, for example, the following articles:

"Japan's $NO_x$ Cleanup Routes", Ushio, S., *Chemical Engineering,* July 21, 1975, pp. 70, 71;

"Bottoming - Cycle Engines", Lindsley, E.F., *Popular Science,* January, 1976, pp. 82 - 85, 130 - 132;

"$NO_x$ Abatement for Stationary Sources in Japan", Ando, J., Tohata, H., and Isaacs, G.A., *Environmental Protection Agency,* Office of Research & Development, EPA-600/2-013*b,* January, 1976; and "$SO_2$ and $NO_x$ Removal Technology in Japan — 1976", Ando, J. *Environmental Technical Information Center,* Japan Management Association, 3-1-22 Shiba Park, Minato-ku, Tokyo, Japan, February, 1976.

However, to the best of my knowledge, no practical, effective technique has yet been proposed for capturing the $NO_x$ formed from a combustion process.

Moreover, since $NO_x$ itself is notoriously toxic and is well recognized as a severe pollutant, efforts are presently directed towards either preventing the formation of $NO_x$ during combustion processes, or towards removing same once formed. The former technique, known in the art as combustion modification, attempts to inhibit the formation of $NO_x$ by operating at reduced combustion temperatures with fuel-air mixtures that are as air-lean as possible. Unfortunately, operating under such conditions inevitably results in a lower energy conversion efficiency which, in turn, wastefully increases fuel consumption.

The second technique mentioned above is known in the art as flue gas treatment wherein $NO_x$ is removed from the cooled flue gas, after it has already been formed, by either catalytic reduction to nitrogen and oxygen or by absorption in a suitable material. These types of controls, while somewhat effective, are unfortunately quite expensive to operate and maintain, since either an expensive catalyst must be replenished, or the sludge resulting from absorption must be disposed of in an environmentally acceptable manner.

While flue gas treatment controls are generally utilized in conjunction with some form of combustion modification program, present day controls for $NO_x$ rely chiefly upon inhibiting the formation of $NO_x$. This is believed due to the fact that once $NO_x$ is formed, it is practically indestructable, i.e., no known process can, by itself, adequately reduce or capture the $NO_x$ before it is emitted into the ambient atmosphere.

It therefore may be appreciated from the foregoing that a technique which not only reduces $NO_x$ pollutant emissions, but increases combustion efficiency while also providing a ready source of $NO_x$ for later transformation into a useful product, would be extremly valuable. In other words, if the $NO_x$ emitted with the stack or exhaust gases from a combustion process could be effectively collected, its role would be reversed from that of a noxious pollutant to that of a valuable resource, for example, as a feedstock for the production of nitrogenous fertilizer.

OBJECTS AND SUMMARY OF THE INVENTION

It is therefore a primary object of the present invention to increase the energy conversion efficiency of combustion processes while simultaneously reducing pollutant emissions by economically and effectively separating, collecting and converting such emissions into valuable resources.

A further object of the present invention is to provide a method and apparatus for reducing pollutant emissions while increasing the efficiency of combustion which takes advantage of a naturally occurring phenomenon within the combustion zone.

Another object of the present invention is to provide a combustion process which reduces fuel consumption, reduces pollutant emissions, leads to the formation of useful and valuable products, and does so economically and efficiently.

Another and further object of the present invention is to provide a technique for reducing the emission of pollutants, including $NO_x$, into the atmosphere from a combustion process, while simultaneously increasing the efficiency of combustion.

A further object of the present invention is to provide a technique for producing $NO_x$ in large quantities which may be later processed into a valuable resource such as nitrogenous fertilizer.

A still further object of the present invention is to provide a technique which facilitates separation, removal and collection of $NO_x$ by enhancing the formation thereof during the combustion process.

A still further object of the present invention is to provide a technique for producing $NO_x$ in sufficient quantities to meet anticipated demands for nitrogenous fertilizer.

A still further object is to increase rather than reduce the formation of $NO_x$ in a combustion process and then recover it in an economically possible manner, with means for reducing the usual polluting effect on the environment by $NO_x$, and accomplishing this by increasing, rather than decreasing, the efficiency of the combustion process.

The foregoing and other objects are attained in accordance with one aspect of the present invention through the provision of a method for reducing pollutant emissions from the gaseous products of a combustion flame, which comprises the step of separating the pollutant emissions from the gaseous product of combustion at the combustion zone of the flame. The pollutant emissions are separated by extracting ionized matter from the gaseous products of combustion at the combustion zone. Aperture means may be provided in or through the sidewall of the combustion chamber adjacent the combustion zone through which the ionized matter may then be extracted. The positive ions of the products of combustion may be attracted to a negatively charged electrode positioned adjacent the aperture means which serves to establish a small electric field across the combustion zone. A collector means may be positioned adjacent the aperture means for collecting the positively charged species for later processing. The electric field is preferably on the order of a few to hundreds of volts per centimeter.

In accordance with yet other aspects of the present invention, apparatus is provided for reducing pollutant emissions from gaseous products of combustion, which comprises means positioned at the combustion zone for separating the pollutant emissions from the gaseous products of combustion. The separating means more particularly comprises means for establishing an electric field at the combustion zone. Means may also be provided for collecting the pollutant emissions once separated from the gaseous products of combustion, the collecting means including aperture means formed in the sidewall of the combustion chamber at the combustion zone. An electrode connected to a negative source of electrical potential may be connected to the collecting means such that the latter serves as the attractive force for the positively charged matter. Preferably, the combustion burner is connected to a source of positive electrical potential and is located upstream of said aperture means.

In accordance with yet other aspects of the present invention, a method is provided for increasing the energy conversion efficiency of a fuel during its combustion while simultaneously reducing pollutant emissions resulting from such combustion, which comprises the steps of combusting the fuel at higher than normal temperatures to produce a hot combustion gas, and extracting pollutant emissions from the hot combustion gas near the combustion zone of the combusting mixture. The high temperature enhances the production of ionized species, the positive ions of which are attracted to a negative source of electrical potential positioned adjacent the combustion zone. The separation of the positive ions is achieved by applying an electrostatic field across the combustion zone which is preferably on the order of a few to hundreds of volts per centimeter.

The present invention, in accordance with other aspects, contemplates a method of producing $NO_x$ which comprises the step of combusting a fuel to produce a main hot gas stream, and separating $NO_x$ from the main gas stream at the combustion zone of the fuel-oxidizer mixture. The method further contemplates the steps of collecting the separated $NO_x$ at the combustion zone, and enhancing the formation of $NO_x$ by combusting the fuel at above-normal combustion temperatures.

BRIEF DESCRIPTION OF THE DRAWINGS

Various objects, features and attendant advantages of the present invention will be more fully appreciated as the same become better understood from the following detailed description thereof when considered in connection with the accompanying drawings, in which.

DETAILED DESCRIPTION OF THE PREFERRED EMBODIMENT

At the elevated temperatures encountered during combustion of fossil fuels, the energy level of the combusting mixture is sufficiently high such that many of the species found in the combustion gases will be ionized to various degrees. The dominant charged species found in the combustion zone are the ions $NO^+$, $H_3O^+$, $CHO^+$, and free electrons. Each of the ionized molecules has a relatively low ionization potential. For example, $NO^+$ has an ionization potential of 9.25 ev. The present invention takes advantage of these low ionization potentials by establishing an electrostatic field at the combustion zone. The electrostatic field acts to separate and collect such positively charged ions before they have been neutralized and had an opportunity to be released to the atmosphere as noxious pollutants; e.g., NO.

Figure 1:
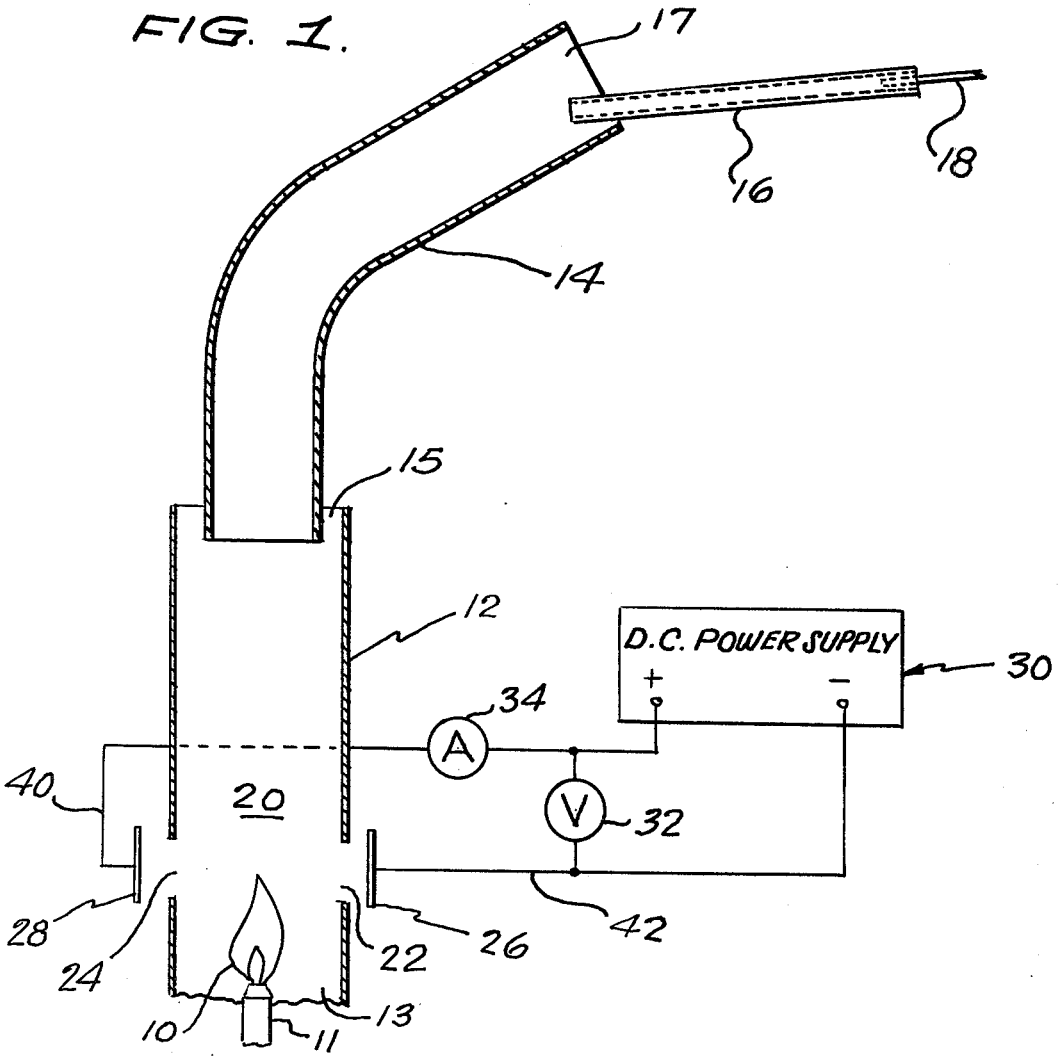
FIG. 1 is a schematic representation of an experimental setup constructed and operated to verify the principles of the present invention.

Referring now to FIG. 1, the drawing schematically illustrates an experimental configuration utilized to verify the principles of the present invention. Reference numeral 10 connotes the general outline of a flame body issuing from a burner 11. The burner 11 is positioned in the mouth 13 of an elongated combustion chamber 12.

The combustion zone of the flame 10 is indicated generally by reference numeral 20. Located in the sidewall of combustion chamber 12 at a position substantially adjacent the combustion zone 20 are a pair of electrodes 26 and 28 which are connected, via lead lines 42 and 40, respectively, to a D.C. power supply 30. Lead 40 is connected to a positive source of potential, such that electrode 28 serves as an anode, while lead 42 is connected to a negative source of potential such that electrode 26 serves as a cathode. The anode 28 and cathode 26 are located near the apertures 24 and 22 in combustion chamber 12 so as to establish an electrostatic field at the combustion zone 20 of the burner 11.

In operation, the positive ions and electrons created during the combustion process will be respectively attracted towards the cathode 26 and anode 28. Thus, during combustion, if a collector is placed adjacent aperture 22, a mixture rich in $NO^+$ and other positive ions will be extracted from the main combustion gases as they pass through the combustion chamber 12. In this manner, the percentage of NO emitted into the atmosphere may be substantially reduced.

Although it is known that ionization occurs at elevated temperatures of combustion, it has been discovered that actual ion concentrations in combustion mixtures are several orders of magnitude higher than predicted assuming thermochemical equilibrium. While the precise nonequilibrium mechanism for explaining such a result has not yet been established, it is believed that chemi-ionization phenomena are responsible. Within the context of the present invention, electric fields as low as one to two volts per centimeter have been found to significantly reduce $NO_x$ emissions.

Experiments have been performed using the equipment components illustrated in FIG. 1 for verifying that $NO_x$ may indeed be extracted from the products of combustion at the combustion zone. One end of a flue 14 was placed in communication with the outlet end 15 of combustion chamber 12. The flue 14 was bent at an approximate 30° angle so as to provide a uniform mixture of the exhaust gases and sufficient cooling in order to enable the measurement procedure to be carried out. An additional glass tube 16 was used to further cool the exhaust gases issuing from opening 17 of flue 14.

Reference numeral 18 indicates schematically a measuring tube inserted in the open end of glass tube 16. Measuring tube 18 is part of a conventional set of detector tubes utilized with a gas concentration detecting instrument, such as, for example, a National/Drager Multi-Gas Detector. Such a machine provides a readout of the parts per million (ppm) of $NO_x$ issuing from the open end of tube 16.

A D.C. power supply 30 was used to establish the electrostatic field across the openings 22 and 24 in the sidewall of combustion chamber 12. The chamber 12 itself consisted of a ceramic cylinder, approximately one-half meter long, with an outside diameter of about 10 centimeters. The distance between cathode 26 and anode 28 was about 15–20 centimeters.

The tests were conducted with two different burners 11, one being a welder's oxy-acetylene torch, the other being a propane torch. The current emitted by power supply 30 was monitored via an ammeter 34, while its voltage output was indicated by a voltmeter 32.

Figure 2:
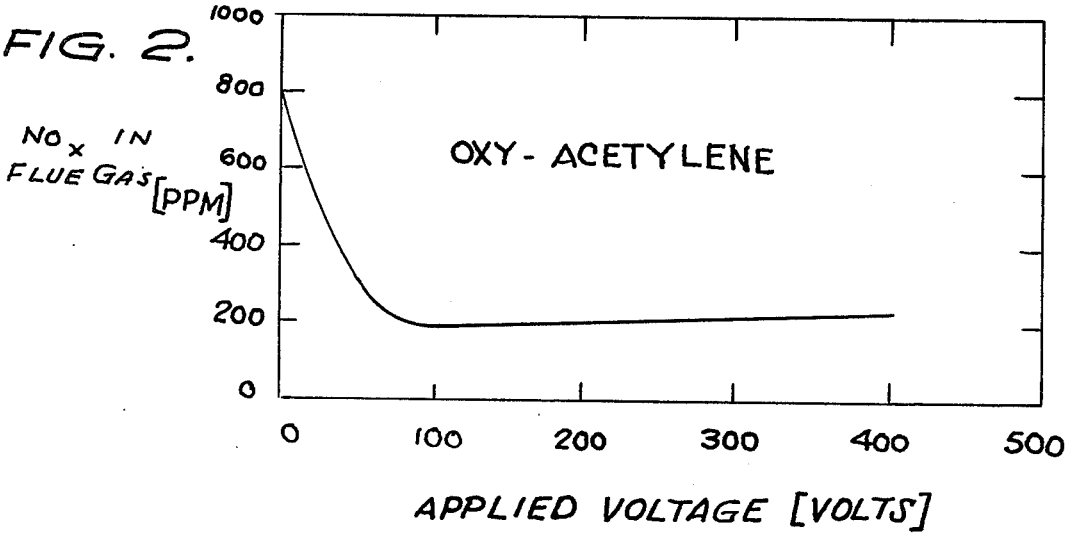
FIGS. 2 and 3 are graphs which illustrate experimental results achieved with the apparatus of FIG. 1.
Figure 3:
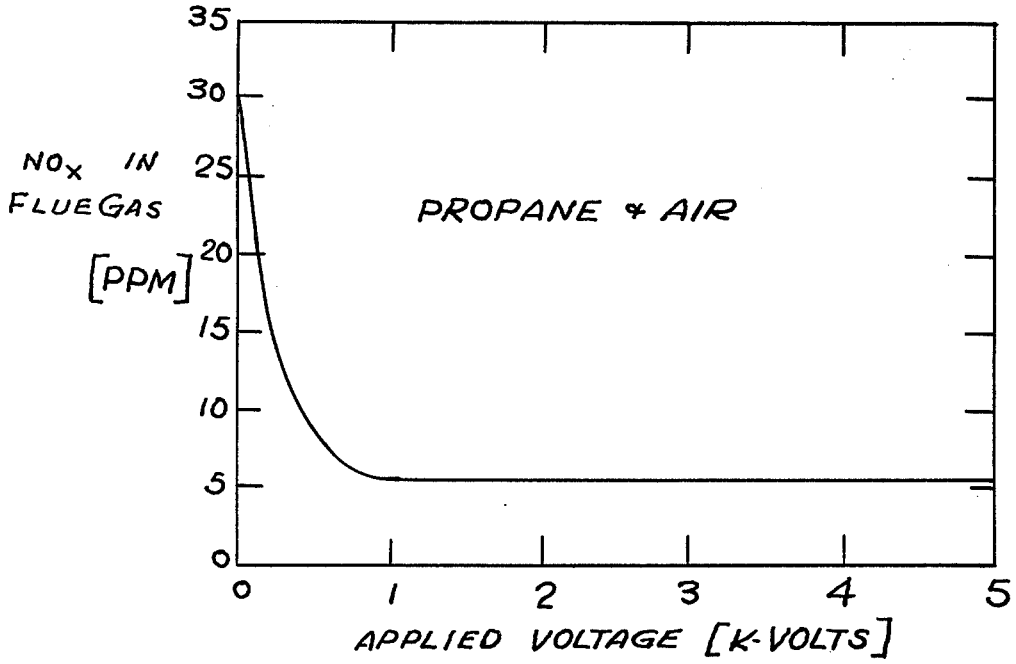

FIGS. 2 and 3 are graphs which plot the detected concentration of $NO_x$ vs. the applied voltage for the oxy-acetylene and propane-air torches, respectively. In general, with the electrostatic field applied across the combustion zone (i.e., normal to the mean mass flow in the flame), the concentration of $NO_x$ was reduced from that without the electric field by as much as $2\frac{1}{2}$ to 5 times. For maximum extraction, the electric field strengths were as low as five to seven volts per centimeter for the oxy-acetylene flames, and fifty to sixty volts per centimeter for the propane-air flames.

Referring more particularly to FIG. 2, it may be seen that with an applied voltage as low as 100 volts, more than 75% of the NO and $NO_2$ mixture was removed from the combustion gases.

FIG. 3 indicates that the minimum applied voltage necessary to obtain the maximum reduction of NO and $NO_2$ in the flue gas was about 800 to 900 volts.

It may be appreciated from comparing FIGS. 2 and 3 that the experiments conducted with the oxy-acetylene torches produced about 25 to 50 times as much NO and $NO_2$ as produced by the propane and air torches. This is believed primarily due to the much higher combustion temperatures of the oxy-acetylene flames (800°–1100° K. hotter than propane-air flames).

Figure 4:
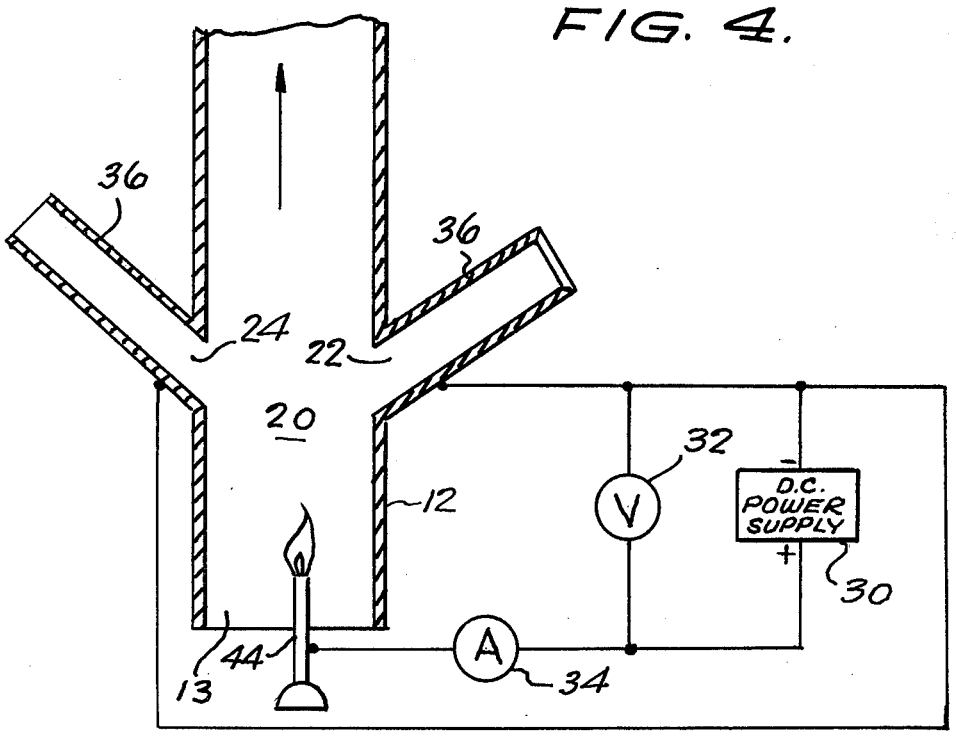
FIG. 4 is a schematic representation of the components which comprise a preferred embodiment of the present invention.

Additional experiments were performed to confirm the collection capabilities of the present invention with the apparatus schematically illustrated in FIG. 4, to which attention is now directed. The components again include a combustion chamber 12 having a pair of apertures 22 and 24 formed in the sidewalls thereof. A pair of cylindrical collector tubes 36 were positioned adjacent the apertures 22 and 24 so as to be in fluid communication with the combustion zone 20. Further, the tubes 36 were electrically connected to one another as well as to a source of negative potential so as to act as collectors of positively charged species. The centers of the apertures 22 and 24 were positioned approximately $14\frac{1}{2}$ centimeters above the tip of torch 44. The torch 44 was itself connected as the positive electrode.

With an oxy-acetylene torch utilized as the burner 44, and an applied electric field of about 25 volts per centimeter, a 14-fold increase was achieved in collecting the $NO_x$ in tubes 36 compared to the amount of $NO_x$ present in the tubes without the applied electric field.

While the details of construction of ion collection chambers with respect to each burner's combustion zone may require individual custom design features, the best mode of the present invention presently contemplates placement of the positive electrode(s) in the vicinity of the burners, fuel injectors, or flame holders, and placement of the negative electrode(s) (electrically separated from the combustion chamber), in and/or near the collection chambers. The outlets of tubes 36 may, of course, be manifolded to a common collector prior to subsequent processing. The collected mixture will, of course, consist of several different previously ionic, now neutralized, species quite highly concentrated within a relatively small amount of flue gas. The separation of the various substances may be accomplished from known chemical processes. In processing the $NO_x$, for example, it may first be passed through an oxidizing catalyst to convert the NO to $NO_2$, or through another oxidizing catalyst to form nitric acid by the reaction:

$$2NO_x + H_2O + (2.5-x)O_2 \rightarrow 2HNO_3.$$

It may be appreciated from the foregoing that the techniques of the present invention differ significantly from prior art pollution controls for combustion processes in that, by virtue of the present invention, NO may be encouraged to form by operating at higher temperatures which may more closely approach stochiometric adiabatic equilibrium temperatures. This, in turn, increases the energy conversion efficiency of the combustion process. NO is effectively and economically separated from the main flue gas stream in the combustion zone by means of a relatively low magnitude electric field to therefore prevent pollution of the environment. The separated NO may be easily collected to be further processed as, for example, a feedstock for nitrogenous fertilizer production.

While the viability of the techniques of the present invention have been specifically described hereinabove within the context of several experimental situations, it will be clear to those skilled in the art that the principles may be easily extended to common combustion environments, such as those occuring in boilers, furnaces, gas turbines, internal combustion engines, and the like.

Further, while the above discussion has centered around the useful separation, removal and collection of the oxides of nitrogen ($NO_x$) it will be apparent to those skilled in the art that other combustion generated pollutants, such as sulfur oxides $SO_x$, carbon monoxide CO, and the unburnt and partially burnt hydrocarbons will also be influenced in a beneficial manner. For example, at the higher recommended combustion temperatures, more complete combustion results in a more complete conversion of harmful CO to benign carbon dioxide and water. Further, since the energy conversion efficiency is higher, less fuel is used, and less thermal waste is emitted. Other pollutants extracted may also prove susceptible to subsequent treatment and use.

Obviously, numerous modifications and variations of the present invention are possible in light of the above teachings. It is therefore to be understood that within the scope of the appended claims, the invention may be practiced otherwise than as specifically described herein.

We claim as our invention:

1. A method of reducing pollutant emissions from the gaseous products of combustion which comprises separating said pollutant emissions from said gaseous products of combustion at the combustion zone by applying a unidirectional electric field at the combustion zone to extract matter which has been naturally ionized within the flame from said gaseous products of combustion.

2. The method of reducing pollutant emissions as set forth in claim 1, further comprising the step of removing said separated pollutant emissions at the combustion zone.

3. The method of reducing pollutant emissions as set forth in claim 1, wherein the magnitude of said electric field is on the order of a few to hundreds of volts per centimeter.

4. The method of reducing pollutant emissions as set forth in claim 1, wherein said electric field is disposed so that the flow of said products of combustion is through said electric field.

5. The method of reducing pollutant emissions as set forth in claim 1, wherein said combustion occurs within a chamber having a sidewall further comprises the step of providing aperture means formed in the sidewall of the combustion chamber adjacent said combustion zone.

6. The method of reducing pollutant emissions as set forth in claim 5, further comprising attracting positive ions from said combustion zone through said aperture means.

7. The method of reducing pollutant emissions as set forth in claim 6, wherein said step of attracting positive ions includes the step of positioning a negatively charged electrode adjacent said aperture means.

8. The method of reducing pollutant emissions as set forth in claim 6, further comprising the step of collecting said positive ions in collector means positioned adjacent said aperture means.

9. The method of reducing pollutant emissions as set forth in claim 8, wherein said collecting step includes the step of connecting a source of negative electrical potential to said collector means.

10. The method of reducing pollutant emissions as set forth in claim 2, further comprising the step of collecting the separated and removed pollutant emissions in a collector means positioned exteriorily of said combustion zone.

11. The method of reducing pollutant emissions as set forth in claim 10, wherein said combustion occurs within a chamber having a sidewall, and further comprising the step of providing aperture means in the sidewall of the combustion chamber at the combustion zone through which said pollutant emissions are removed.

12. The method of reducing pollutant emissions as set forth in claim 11, further comprising the step of providing negatively charged collector means adjacent said aperture means whereby positively charged matter will be attracted from said gaseous products of combustion.

13. Apparatus for reducing pollutant emissions from gaseous products of combustion of a burner, which comprises means positioned at the combustion zone of a burner for establishing a unidirectional electric field at said combustion zone to thereby separate the pollutant emissions which have been naturally ionized within the flame from the gaseous products of combustion.

14. The apparatus as set forth in claim 13, further comprising means for collecting said pollutant emissions once separated from said gaseous products of combustion.

15. The apparatus as set forth in claim 14, wherein said combustion occurs within a chamber having a sidewall, and wherein said collecting means includes aperture means formed in the sidewall of the combustion chamber at said combustion zone.

16. The apparatus as set forth in claim 15, wherein said collecting means further comprises means for attracting positively charged matter.

17. The apparatus as set forth in claim 16, wherein said attracting means comprises electrode means connected to a source of negative electrical potential.

18. The apparatus as set forth in claim 17, wherein said electrode means comprises a collection chamber in fluid communication with said aperture means.

19. The apparatus as set forth in claim 18, wherein said burner is connected to a source of positive electrical potential.

20. The apparatus as set forth in claim 19, wherein said electric field is established by said positive and negative sources of electrical potential and is on the order of a few to hundreds of volts per centimeter.

21. A method of increasing the energy conversion efficiency of a fuel during combustion while simultaneously reducing pollutant emissions resulting from such combustion, which comprises the steps of:

applying an electrostatic field at the combustion zones;

combusting said fuel at higher than normal temperatures to produce a hot combustion gas which contains matter that has been naturally ionized within the flame; and thereby extracting pollutant emissions from said hot combustion gas near the combustion zone of said fuel.

22. The method as set forth in claim 21, wherein said combusting step includes the step of producing a large number of positively charged species.

23. The method as set forth in claim 22, wherein said extracting step includes the step of separating said positively charged species from said hot combustion gas in the combustion zone.

24. The method as set forth in claim 23, wherein said separating step comprises the step of applying a negative source of electrical potential adjacent said combustion zone.

25. The method as set forth in claim 21, wherein said electrostatic field is on the order of a few to hundreds of volts per centimeter.

26. The method as set forth in claim 23, further comprising the step of collecting said positively charged species for later conversion into useful products.

27. A method of producing NO, comprising the step of combusting a fuel to produce a main hot gas stream, and separating $NO^+$ from said main gas stream at the combustion zone of said fuel.

28. The method as set forth in claim 27, further comprising applying an electrostatic field at said combustion zone and collecting said separated $NO^+$ at the combustion zone of said fuel.

29. The method as set forth in claim 28, further comprising the step of enhancing the formation of $NO^+$ by combusting said fuel at above-normal combustion temperatures.

30. The method as set forth in claim 28, wherein said step of collecting includes the step of positioning a negatively charged electrode adjacent an opening in the combustion chamber for attracting the positively charged species therethrough.

31. The method as set forth in claim 28, wherein the magnitude of said electrostatic field is on the order of a few to hundreds of volts per centimeter.

32. The method as set forth in claim 30, wherein said step of collecting further includes the step of connecting collecting means to said negatively charged electrode.

33. The method of claim 1, wherein said pollutant emissions are at least one of $NO_x$ or $SO_x$.

34. The method of claim 33, wherein said pollutant emissions are $NO_x$.

35. The method of claim 33, wherein said pollutant emissions are $SO_x$.

36. The method of claim 21, wherein said pollutant emissions are at least one of $NO_x$, $SO_x$, CO, unburnt hydrocarbons, or partially burnt hydrocarbons.

37. The method of claim 36, wherein said pollutant emissions are $NO_x$.

38. The method of claim 36, wherein said pollutant emissions are $SO_x$.

* * * * *